United States Patent [19]

Douglas

[11] Patent Number: 4,500,122

[45] Date of Patent: Feb. 19, 1985

[54] FASTENER FOR SLIDING DOORS OR WINDOWS

[75] Inventor: Jack E. Douglas, Walsall, England

[73] Assignee: Arthur Shaw Manufacturing Limited, Rose Hill, England

[21] Appl. No.: 511,587

[22] Filed: Jul. 7, 1983

[30] Foreign Application Priority Data

Jul. 24, 1982 [GB] United Kingdom ..... 8221460

[51] Int. Cl.[3] ..... E05C 1/16

[52] U.S. Cl. ..... 292/161; 292/341.15; 292/DIG. 46

[58] Field of Search ..... 292/160, 161, 156, 246, 292/341.15, DIG. 41, DIG. 46, DIG. 68

[56] References Cited

U.S. PATENT DOCUMENTS

| | | | |
|---|---|---|---|
| 1,036,325 | 8/1912 | Perry | 292/DIG. 46 |
| 1,398,044 | 11/1921 | Sheinman | 292/161 X |
| 1,438,547 | 12/1922 | O'Connor | 292/161 |
| 3,213,652 | 10/1965 | Tucker | 292/DIG. 46 |
| 4,025,096 | 5/1977 | Geer | 292/158 |

*Primary Examiner*—Richard E. Moore
*Attorney, Agent, or Firm*—Larson and Taylor

[57] ABSTRACT

A fastener for sliding doors or windows comprises one or more bolt assemblies 8 having spring loaded bolts with heads 15 mounted in housing set into the stile 7. The fastener also comprises a receiver assembly 9 including a pair of rails 23,24 having similar aligned keyhole openings 25,26 respectively. The outer retainer rail 23 is slidable relative to the inner rail by operation of an actuator 27 controlled by a handle assembly 10. When the bolt heads 15 are received in the aligned openings 25,26 on closing of the stile 7 to the jamb, the handle 29 of the assembly 10 is turned causing the retainer rail 23 to move downwards to trap the heads 15 of the bolt in the narrower parts of each opening 25 in the retainer rail 23. The handle assembly 10 preferably includes a lock to prevent the handle 20 being rotated after locking. The spring loaded bolts provide a "buffer" action and prevent damage to the receiver assembly even if in the fastening position. The bolt assemblies may be mounted on a jamb with the receiver and handle assemblies on the stile.

8 Claims, 5 Drawing Figures

FASTENER FOR SLIDING DOORS OR WINDOWS

BACKGROUND OF THE INVENTION

This invention relates to a fastener for sliding doors or windows.

In fasteners for sliding doors or windows it is desirable to provide a fastener which avoids damage to the stile and or jamb when the movable member is slammed or closed onto the receiver or striker, particularly if the handle or lock has been moved to a locking or projecting position whilst the member has been open. In some types of known fasteners having hook-shaped bolts which project outwardly like claws, considerable damage can be done on slamming and the hooks are dangerous projections.

In other types of known fasteners, there are bolts which are driven out from the opposed sides of the member to engage in holes or retainers arranged on the frame to receive the bolts on extension. One problem is that the bottom holes or retainers become filled with dirt or corrode. Another problem is that if the bolts are extended inadvertently at the wrong position, with or without the sliding member being moved, considerable damage may ensue and the whole door or window may be jammed.

Both of these types of fasteners are complex to manufacture and to install. Furthermore and often consequently, if damaged or causing damage, the reparations are very costly.

SUMMARY OF THE INVENTION

It is an object of this invention to provide an improved fastener for sliding doors or windows which is simple to install and which avoids damage on slamming or improper use.

It is a further object of this invention to provide an improved fastener for sliding doors or windows which can be provided with a security lock for selected operation to lock the fastener in the closed position.

Other objects and advantages and merits of this invention will be derived from the description later herein of an exemplary embodiment.

According to this invention we provide a fastener for sliding doors or windows, the fastener comprising a bolt assembly adapted to co-operate with a receiver assembly operable by an actuator under the control of a handle, the bolt assembly including a sprung loaded headed bolt arranged to be received within aligned openings in two overlying rails of the receiver assembly, and on rotation of the handle the actuator slides a retainer one of the rails relative to the other rail to engage and hold the bolt head.

By this arrangement, the rails of the receiver assembly may be mounted lengthwise of a jamb which also mounts the actuator and handle. The bolt assembly, or a plurality of same, is/are carried on the stile of the movable member to be brought into register with the openings in the rails of the receiver assembly on closing of the member. The spring loading of the bolts ensures that if the movable member is slammed, and if the receiver assembly is in the incorrect position no damage is caused, and the bolts act as "buffers".

Furthermore, the installation does not involve complex movable parts like shoot or hook bolts to be projected in operation.

Preferably, the retainer rail of the receiver assembly overlies a fixed guide rail, and the openings in the retainer rail are substantially key-hole shape.

By using this arrangement, the key-hole openings permit the head of the bolt to be received through the largest part, and by selecting dimensions of the neck of the bolt and the narrower slot portion of the opening, when the retainer rail is moved, the neck of the bolt extends through that narrower part to retain the bolt head effectively.

Conveniently, the openings in both rails of the receiver assembly are similar. This simplifies manufacture and alignment on assembly and installation.

Preferably, the handle assembly comprises a pivotal handle for controlling the actuator.

By using this arrangement, the conventional and customary operation like a lever-type handle controlling a latch is provided to the user, and there is a direct feedback to the user of the force or effect of actuation. In other fasteners, particularly like those types mentioned, most of the operating force is applied through a key which, in practice is a weak link in the fastener.

In one preferred form of fastener, the handle is pivotally mounted on an escutcheon, and the handle carries a lock for securing the handle relative to the escutcheon against relative pivotal movement.

By providing a lock in the handle to secure it to the escutcheon, a particularly effective and secure locking fastener is obtained.

Preferably, the lock is a spring loaded plunger with a cylindrical barrel for operation by a key with the plunger being receivable in the escutcheon.

By providing a spring loaded plunger lock, when the lock is undone, there is no interference with normal pivotal movement of the handle for operating the fastener. Furthermore individual security can be achieved by selection and variation of tumbler or pin types for the lock and key sets.

Other inventive and special features as claimed will be particularly mentioned later with reference to an exemplary embodiment depicted in the accompanying drawings.

DETAILED DESCRIPTION OF THE EXEMPLARY EMBODIMENTS

Figure 1:
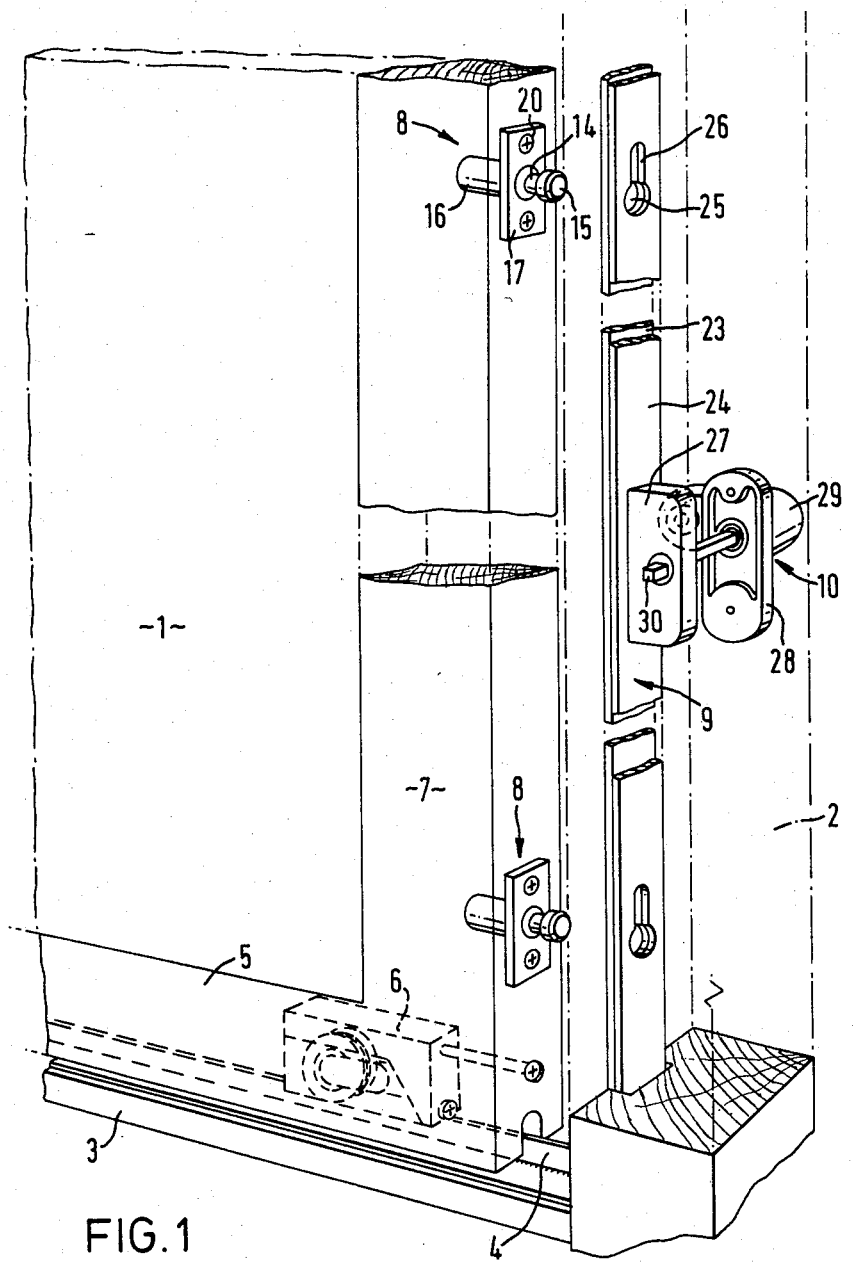
FIG. 1 is a rear perspective view of the fastener as mounted for use in a sliding door.

With reference first to FIG. 1, the fastener is for use with a member 1 such as a door or window arranged to slide relative to a fixed frame having a jamb 2 and a sill 3 on which an upstanding rail section 4 is mounted. The member 1 has a bottom rail 5 within which a roller assembly 6 is mounted and a stile 7. The member 1 and frame are conventional, and for convenience are only partially depicted. In known manner, the member 1 is arranged to open and close relative to the jamb 2.

The fastener comprises one or more bolt assemblies 8 mounted on the stile 7, a receiver assembly 9, and lockable operating handle assembly 10 arranged on actuation to operate the receiver assembly 9.

Figure 4:
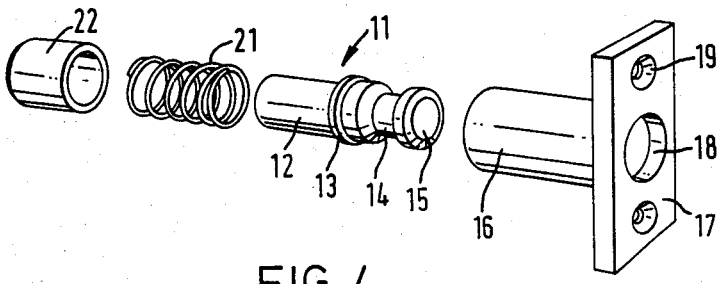
FIG. 4 is a detail exploded view of a bolt assembly.

A bolt assembly 8 as shown in FIG. 4 comprises a bolt member 11 having a cylindrical body 12 formed with a shoulder 13 tapering to a neck 14 and terminating in a head 15. The bolt member 11 is received within a cylindrical tubular housing 16 having a rectangular mounting plate 17 at one end. The mounting plate 17 has an opening 18 through which the bolt head 15 projects and there are countersunk holes 19 provided by means of which the bolt assembly may be secured by screws 20 to the stile 7.

A helical spring 21 is mounted on the bolt body 12 and is retained thereon by a plug closure 22 which is a force fit within the end of the housing 16. One end of the spring 21 abuts the inside of the closure 22 and the other end abuts the shoulder 13 so that the bolt member 11 is spring loaded so that the head 15 and neck 14 project outwardly from the mounting plate 17 as shown in FIG. 1. The head 15 of the bolt member 11 may be displaced into the housing when pressure is applied to overcome the spring loading.

The bolt assembly 8 may be mounted in a wooden stile by boring or drilling a suitable clearance hole to receive the housing 16 with the mounting plate 17 being seated in a rebate so that it lies flush with the face of the stile. Each bolt assembly would be mounted to be in register with fastening locations of the receiver assembly 9.

The receiver assembly 9 comprises two similar flat bars or rails of which the outer retainer rail 23 overlies an inner guide rail 24 for relative limited sliding movement. Each rail 23,24 is formed at evenly spaced positions with key-hole shaped openings 25,26 respectively. The slidable retainer rail 23 is held and supported on the rail 24 for relative movement by means of an actuator 27 associated with the handle assembly 10. The rails 23 and 24 are provided as an assembly for face fitting to a clearance rebate formed in the jamb, and to secure the rails thereto suitable fixing holes and slots (not shown) are provided. The rails 23,24 may be supported in a frame (not shown).

The key-hole openings 25,26 have a maximum opening dimension sufficient to provide clearance for the bolt head 15. The narrow slot portion of at least the opening 25 in the retainer rail 23 is sufficient to clear just the neck 14 of the bolt member so that when a bolt member 11 is received in two aligned openings 25,26 and the retainer rail 23 is moved downwardly, the head is trapped and secured as the narrow portion of the hole 25 extends around the neck 14 with the head being received within the hole 26 in the fixed inner rail.

Figure 2:
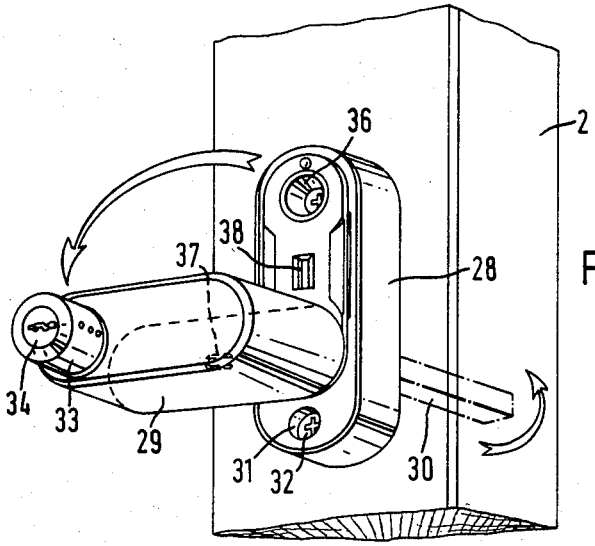
FIG. 2 is a front perspective detail view of the locking handle of the fastener shown in the open position.
Figure 3:
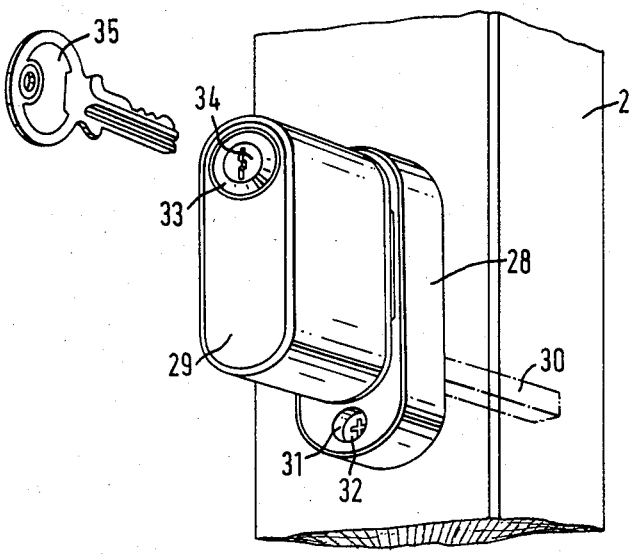
FIG. 3 is a detail view similar to FIG. 2 but with the handle shown in the locked closed position.

The handle assembly 10 as shown in FIGS. 1, 2 and 3 comprises an escutcheon 28 mounting a handle 29 carrying a square section spindle 30 which extends through the escutcheon 28 and is turned by the handle. The escutcheon 28 has fixing holes 31 for securing the handle 29 and escutcheon to the front face of the jamb 2 by screws 32. The handle 29 is pivotally mounted on the escutcheon 28, and remote from the pivot axis the handle mounts a spring loaded cylinder lock 33 having a rotatable cylinder 34 operable by a key 35. The lock 33 has a plunger (not shown) which extends from the rear of the lock and this is arranged to be received in a receiver formed by an opening 36 in the escutcheon.

As will be appreciated from the two views of FIGS. 2 and 3, when the lock 33 is unlocked (FIG. 2), the handle 29 can be rotated to turn the spindle 30. When the handle is in the locking position (FIG. 3), the lock 33 may be operated by the key 35 to lock the cylinder 34 against turning with the plunger engaging in the hole 36 to secure the handle 29 in that position.

To ensure that the handle 29 is easily located in the locking position, a detent 37 is provided in the rear face of the handle to engage with a shallow recess 38 formed in the escutcheon 28. By this detent, adequate "feel" and "hold" on rotating the handle is achieved for the user.

The rotation of the handle 29 and the spindle operates the actuator 27 for the retainer rail 23 mounted on the guide rail 24. The detail of the actuator 27 is not shown but includes a quadrant or toothed drive member which is turned by the spindle. This drive member is coupled to the retainer rail 23 and on movement by the spindle causes the retainer rail to move relative to the guide rail to alter the registration of the pairs of outer and inner key-hole openings 25,26.

Following the above description of the construction, it will now be appreciated that in use of the fastener, the receiver assembly 9 and handle assembly 10 are mounted on a jamb 2 with the required number of bolt assemblies 8 mounted at positions spaced along the stile 7 in alignment with the key-hole openings 25,26 in the receiver assembly.

As the member 1 is closed onto the jamb 2 when the handle 29 is in the unlocked position, the bolt heads 15 enter into respective aligned openings 25,26. On turning the handle 29 the retainer rail 23 is moved downwards so that the bolt heads 15 are trapped by their necks 14 engaged in the narrow part of the openings 25. If desired, the handle 29 may be locked by using the key 35.

If the member 1 is open and the handle 29 should be in the closed or locking position, then on closing movement so that the bolt heads 15 strike the receiver assembly 9, the heads 15 cannot be received behind the retainer rail 23 and the bolts are merely pushed back into their respective housings. By this action the bolt acts as buffers causing the door or window member to rebound slightly and, importantly, no damage is sustained to the receiver assembly or the jamb or the stile.

Figure 5:
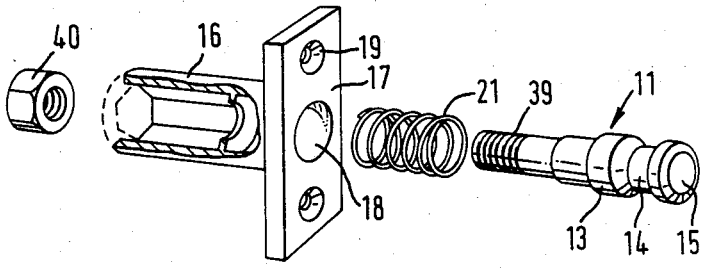
FIG. 5 is a detail exploded view of an alternative bolt assembly.

In the alternative form of bolt assembly depicted in FIG. 5, the bolt member 11 and housing 16 are very similar to those first described with reference to FIG. 4. However, in this assembly, the bolt member has a threaded end 39 arranged to engage a nut 40 located against rotation in a hexagonal bore in the housing 16. By this arrangement the spring loading and extent of the bolt head 15 from the mounting plate 17 may be adjusted by rotating the bolt member 11. This alternative may be provided where fine adjustment on installation is required.

As will be understood, in fitting the invented fastener, it is possible to fit the receiver assembly to the jamb by simple operations, and the stile of the window or door merely has to be bored or drilled to receive the bolt assemblies. The operations are principally face fixings which are preferred on installation and assembly.

The fastener can be used, if desired, with the receiver assembly mounted on the stile and the bolt assemblies carried on the jamb. The disposition is at the preference of the user or installer.

The fastener can be used with timber or with metal frames having a hollow or semi-hollow profile. In the latter case, designed sections and/or secondary mounting plates may be used.

The handle assembly may be made without the cylinder lock and a simple sprung loaded plunger with a manual release knob may be employed, or a positive detent retainer may be provided. However, one advantage of the use of the cylinder lock in the construction shown is that of security for it is difficult to apply leverage or other force to the handle to break the lock mechanism.

In accordance with the type of locking or fastening required for the door or window, the handle assembly may include an additional handle on the opposed side of the stile for operation of the fastener from both sides of the door or window.

Other advantages and merits of this invention will be apparent to those skilled in the art.

I claim:

1. A fastener for sliding doors, windows or the like comprising:

a receivor assembly including two overlying rails, one of said rails being a retainer rail which is slidable relative to the other of said rails, said receivor assembly further including aligned openings in said overlying rails;

a bolt assembly including a headed bolt and a spring means for spring loading said headed bolt towards said aligned openings in said receivor assembly; and a handle means operatively connected to said receivor assembly for sliding said retainer rail relative to said other rail to engage and hold the head of said bolt.

2. A fastener for sliding doors, windows or the like, comprising:

a receivor assembly including two overlying rails, one of said rails being a retainer rail which is slidable relative to the other of said rails, said receivor assembly further including a plurality of spaced apart aligned openings in said overlying rails;

a plurality of bolt assemblies, each said bolt assembly including a headed bolt and a spring means for spring loading respective ones of said headed bolts towards a respective one of said plurality of aligned openings in said receivor assembly; and a handle means operatively connected to said receivor assembly for sliding said retainer rail relative to said other rail to engage and hold the heads of said bolts.

3. The fastener according to claim 1 wherein said retainer rail of the receiver assembly overlies a fixed guide rail, and said openings in said retainer rail are of substantially key-hole shape.

4. The fastener according to claim 3 wherein said openings in both said rails of said receiver assembly are similar.

5. The fastener according to claim 1 wherein said handle assembly comprises a pivotal handle for controlling sliding actuation of said retainer rail.

6. The fastener according to claim 5 wherein said handle is pivotally mounted on an escutcheon, and said handle carries a lock for securing said handle relative to said escutcheon against relative pivotal movement.

7. The fastener according to claim 1 wherein there are a plurality of said bolt assemblies, and said receiver assembly includes a plurality of said aligned openings spaced apart lengthwise of said receiver assembly.

8. The fastener according to claim 1 wherein the spring loading of said bolt assembly is adjustable.

* * * * *